US009585451B2

(12) United States Patent
Velentzas et al.

(10) Patent No.: US 9,585,451 B2
(45) Date of Patent: Mar. 7, 2017

(54) CARD HOLDER

(71) Applicants: Michael Velentzas, Boston, MA (US); Andrea Elia, Somerville, MA (US)

(72) Inventors: Michael Velentzas, Boston, MA (US); Andrea Elia, Somerville, MA (US)

( * ) Notice: Subject to any disclaimer, the term of this patent is extended or adjusted under 35 U.S.C. 154(b) by 4 days.

(21) Appl. No.: 14/606,006

(22) Filed: Jan. 26, 2015

(65) Prior Publication Data

US 2015/0208778 A1 Jul. 30, 2015

Related U.S. Application Data

(60) Provisional application No. 61/931,597, filed on Jan. 25, 2014.

(51) Int. Cl.
*A45C 11/18* (2006.01)
*A45C 1/06* (2006.01)

(52) U.S. Cl.
CPC ..... *A45C 11/182* (2013.01); *A45C 1/06* (2013.01); *A45C 2001/062* (2013.01); *A45C 2001/065* (2013.01)

(58) Field of Classification Search
CPC .. A45C 2001/065; A45C 11/82; A45C 11/182
USPC ..... 150/147, 149; 206/37, 39.4, 39.5
See application file for complete search history.

(56) References Cited

U.S. PATENT DOCUMENTS

| | | | | | |
|---|---|---|---|---|---|
| 2,287,521 | A * | 6/1942 | Handley | A45C 11/324 | 206/37.2 |
| 4,697,698 | A * | 10/1987 | Holdener | A45C 11/182 | 206/37 |
| 5,487,291 | A * | 1/1996 | Voigt | A45C 11/32 | 206/37.2 |
| 6,581,762 | B2 * | 6/2003 | Keough | A45C 11/182 | 206/39.4 |
| 2003/0057112 | A1 * | 3/2003 | Keough | A45C 11/182 | 206/39.4 |
| 2005/0087454 | A1 * | 4/2005 | Chen | A45C 11/18 | 206/39 |
| 2008/0163964 | A1 * | 7/2008 | Brannon | A45C 11/182 | 150/147 |
| 2014/0060712 | A1 * | 3/2014 | Beckley | A45C 1/06 | 150/133 |

FOREIGN PATENT DOCUMENTS

GB 25677 * 0/1910

* cited by examiner

*Primary Examiner* — Sue A Weaver

(57) ABSTRACT

A card holder is provided, having at least one compartment that holds at least one card. When the compartment is slid open, at least one card is made accessible. There are preferably multiple compartments that make up the card holder, each compartment revealing a different card when slid to an open position.

19 Claims, 9 Drawing Sheets

CARD HOLDER

RELATED APPLICATIONS

The present U.S. Utility Patent Application claims priority pursuant to 35 U.S.C. §119(e) to U.S. Provisional Application No. 61/931,597 entitled "Multi Directional Sliding Card Holder" filed Jan. 25, 2014, hereby incorporated by reference in its entirety and made part of the present U.S. Utility Application for all purposes.

BACKGROUND OF THE INVENTION

This application relates to wallets and card-holders, specifically ones that can store, organize, and eject wallet-sized cards (like driver's license ID's, credit cards, debit cards, and RFID passes). Wallets and card-holders typically store numerous cards in a stack, a single sleeve, stacked sleeves, or in a cascading set of sleeves. These methods for organizing cards do not lend to the quick ejection or removal of individual cards because they rely on precise and tedious finger work to extract individual cards. Existing wallets and card holders that do employ ejection mechanisms often do not allow for selective removal of specific cards, and if they do, it is achieved through bulky designs that rely on buttons, springs, and thick sleeves—all elements that add thickness to the design and result in discomfort to the user. These limitations have led to the need for a card-storage design that speeds up the process of card extraction without compromising on organization or adding to thickness.

BRIEF SUMMARY OF THE INVENTION

The invention relates to a card holder that slides open to permit access to a card stored therein. In some embodiments, the card holder slides open in multiple directions to provide access to various different cards stored therein. The aim of this invention is to improve on the storage and retrieval of wallet-sized cards.

The invention is made up of elements, features and components that are assembled to interlock in a manner that the components slide with respect to one another to expose cards stored inside. This sliding motion can happen in multiple directions to expose separate cards and allow for their easy retrieval.

The invention is made up of multiple layered components. A base component can hold a sliding component on a top side, a bottom side, or both sides thereof. These sliding components on either side of base component can also hold an additional sliding component on the side opposite the base component. Each sliding component is shaped to store a card therein. All of these components are preferably connected in a manner that allows for the components to slide with respect to one another. The Additionally, stoppers, resilient features and folded features in each component keep the card in place and prevent the sliding components from sliding beyond their necessary limits. The card holder functions such that one, several, or all, of its components can be slid open to reveal one, multiple or all of the cards at once. The components can, in some embodiments, all slide autonomously in a way that does not prohibit the sliding action of any of the other components.

In some embodiments, the card holder can include a cover that protects the surface of the outermost components. If desired, this cover can incorporate another slot for a card. This cover would, in some embodiments, have no inherent ejection mechanism associated with it and would be used to store less frequently used cards like RFID cards that can be scanned with proximity and not swiping, for example.

DETAILED DESCRIPTION

Figure 1:
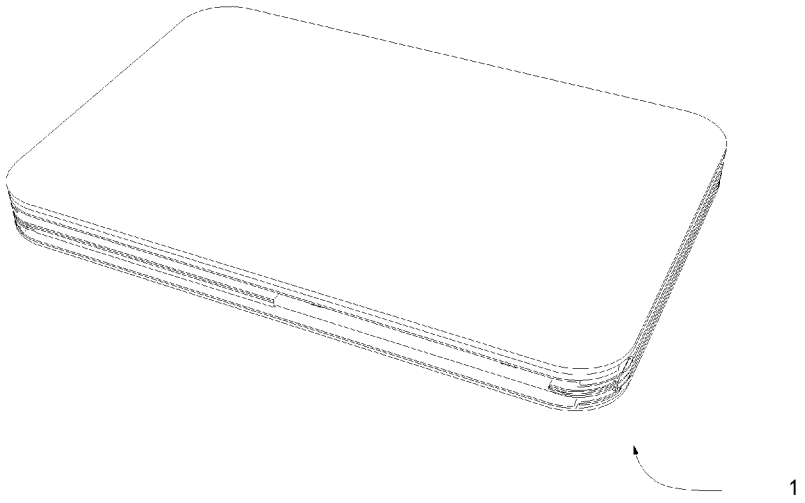
FIG. 1 shows a top perspective view of one embodiment of the invention in closed configuration.
Figure 2:
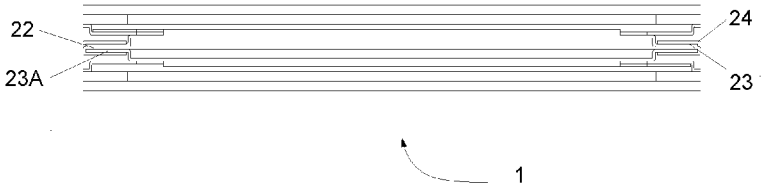
FIG. 2 shows a front elevation of the shorter edge of the embodiment of the invention in FIG. 1 in its closed configuration.
Figure 3:
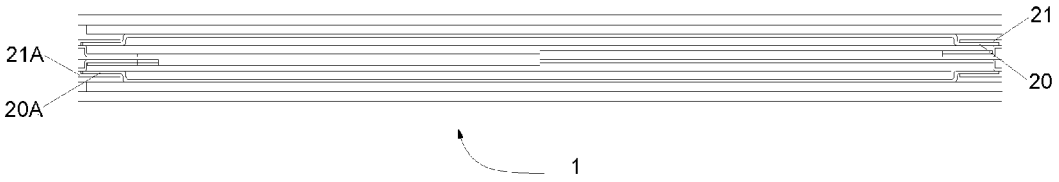
FIG. 3 shows a side elevation of the longer edge of the embodiment of the invention in FIG. 1 in its closed configuration.

Embodiments of the card holder of the present invention are generally referred to throughout FIGS. 1-13 by the reference numeral 1. FIG. 5 shows one embodiment of the invention where card holder 1 has four sliding card storage compartments made from the assembly of components 6,7, 8,7A, and 6A as well as two static card storage components in the outermost sliding components 6/6A. These components are, in turn, made up of the elements and features depicted in FIG. 4. FIGS. 2 and 3 show a front and side view of the card holder 1, respectively, to demonstrate the thickness of a card holder with four sliding components, as well as how the various features and elements come together.

Figure 4:
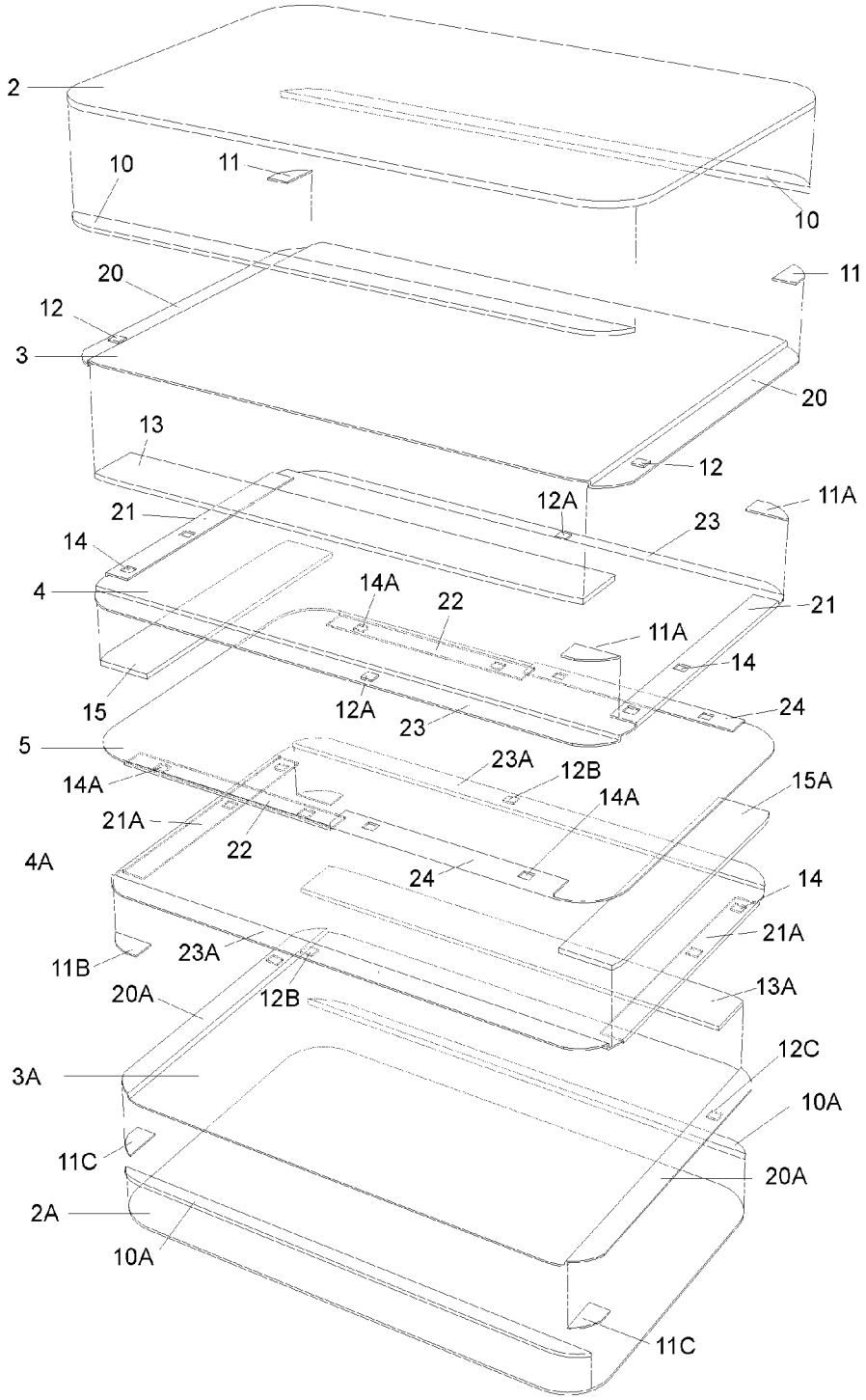
FIG. 4 shows an exploded perspective of the individual elements of the embodiment of the invention in FIG. 1.
Figure 5:
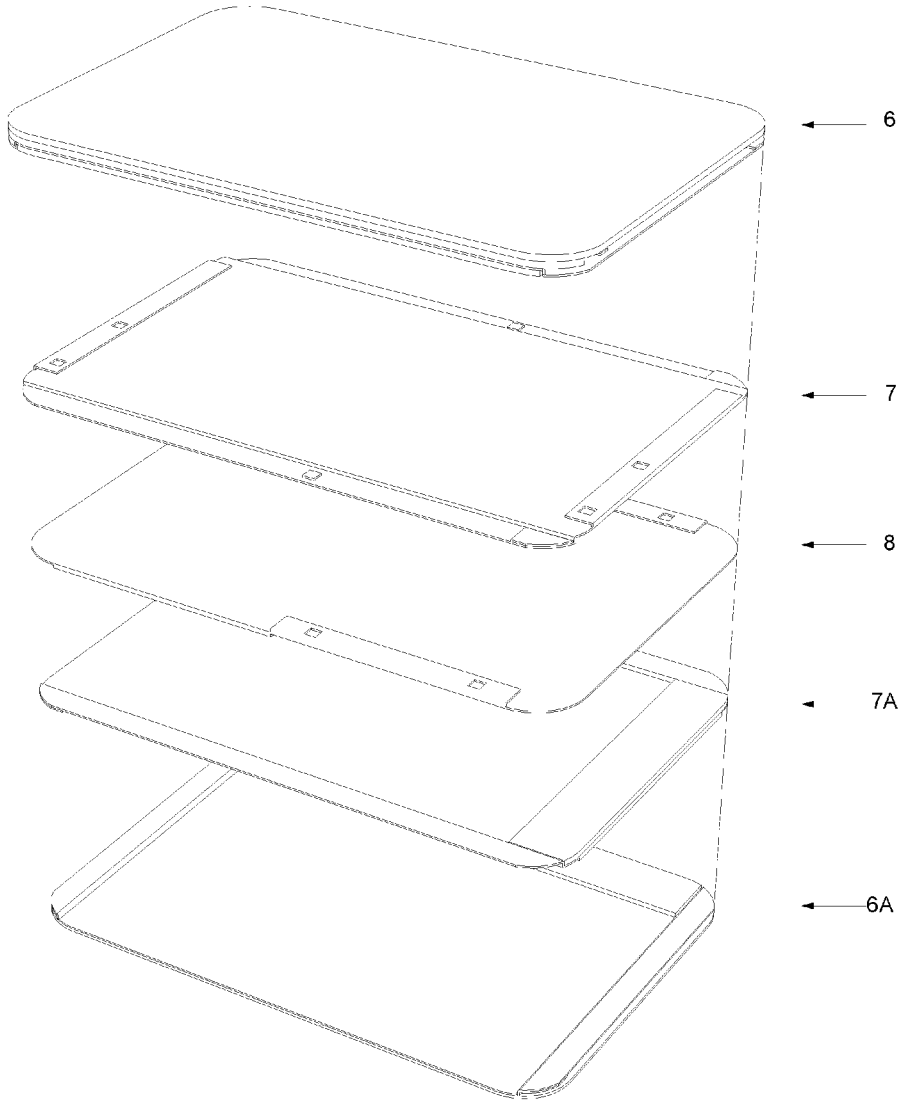
FIG. 5 shows an exploded perspective of the elements from FIG. 4 assembled into distinct components.
Figure 6:
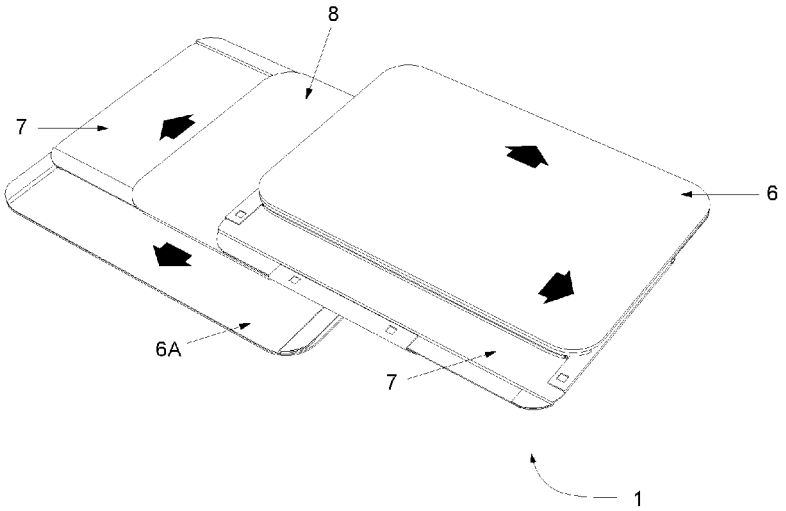
FIG. 6 shows the embodiment of the invention in FIG. 1 assembled and fully expanded with arrows indicating the direction in which the components slide to open.
Figure 7:
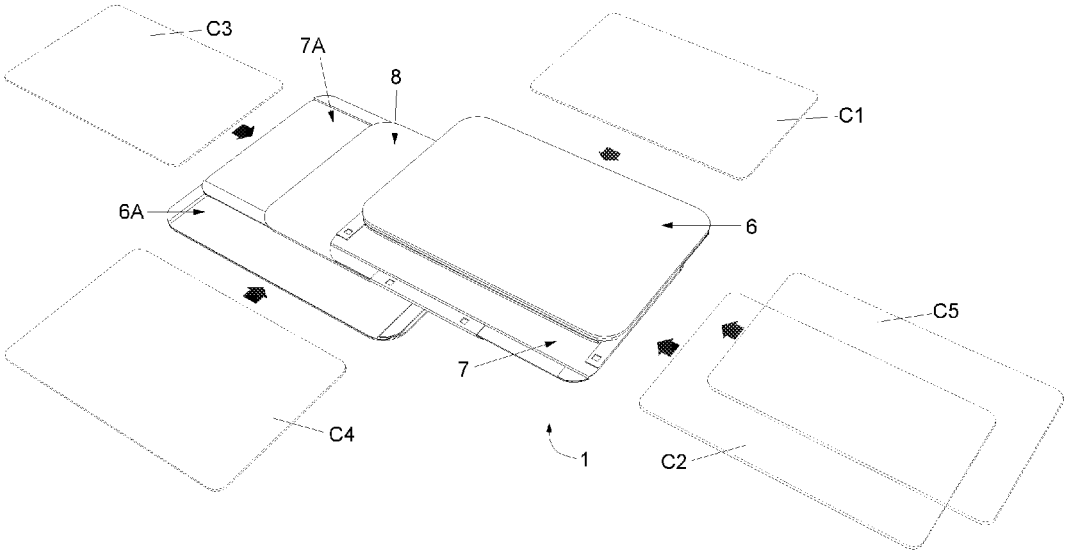
FIG. 7 shows the embodiment of the invention in FIG. 1 assembled and fully opened with a schematic illustration of placement and direction of insertion of the cards.

The main components 6,7,8,7A, and 6A shown as distinct assemblies in FIG. 5 are shown in an exploded view in FIG. 4, where second top sliding component 6 is made up of elements 2, 3, 10, 11, 12, 13 and feature 20; first top sliding component 7 is made up of elements 4, 11A, 12A, 15 and features 21, 23 and 14; base component 8 is made up of element 5 and features 14A, 22, and 24; first bottom sliding component 7A is made up of the joined elements 4A, 11B, 12B, 15A and features 21A, 23A and 14; and second bottom sliding component 6A is made up of the joined elements 2A, 3A, 10A, 11C, 12C, 13A and feature 20A; with each of these components, elements and features being more fully described below.

Figure 8A:
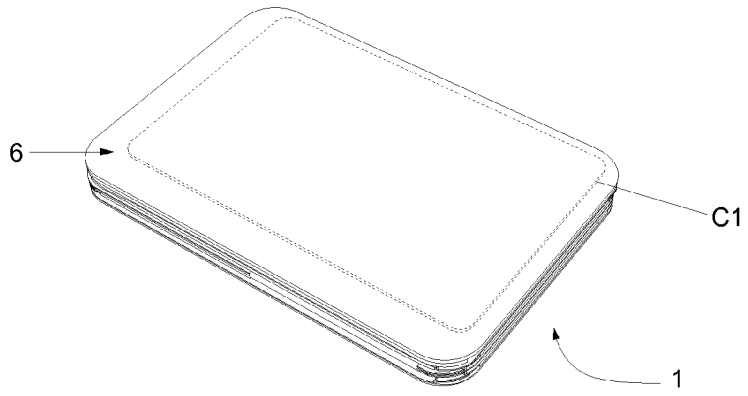
FIG. 8A shows a top perspective view of the embodiment of the invention in FIG. 1 in its closed position with the location of the first card (from the top) called out with dashed lines.
Figure 8B:
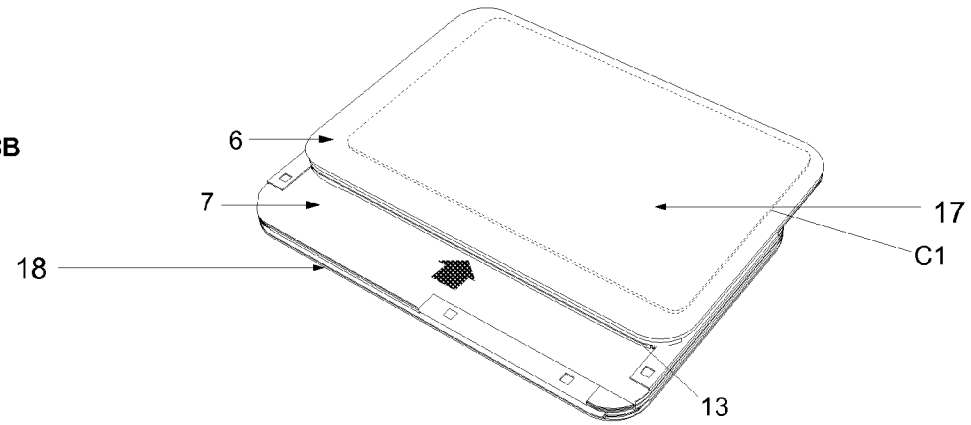
FIG. 8B shows a first component (from the top) of the embodiment of the invention in FIG. 1 slid open to its full extents with the first card ejected from it.
Figure 8C:
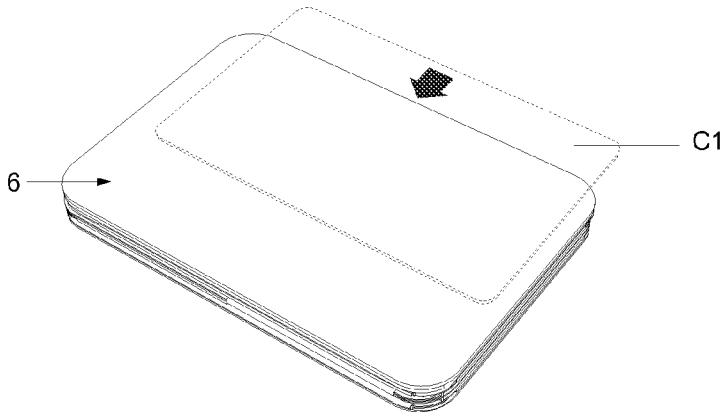
FIG. 8C shows the first component of the embodiment of the invention in FIG. 1 returned to its closed position after having ejected the first card.

In second top slider component 6, cover piece 2 is the topmost piece of the card holder 1. The two riser elements 10 connect the cover piece 2 to the outermost surface of storage element 3 of the second top sliding component 6, and in doing so creates a cavity for card C5 (see FIGS. 7 and 12). Sliding edge 20 is formed in one embodiment as a folded tongue feature of storage element 3 that fits into the groove 21 of storage feature 4 to allow the second top sliding component 6 to slide along the width of the first top sliding component 7 (FIGS. 6 and 8) and reveal card C1. Stop element 11 and retention element 12 are disposed on sliding edge 20 to restrict the movement of sliding edge 20 through groove 21 (FIG. 4). In particular retention element 12 mates with positioning element 14 in one of two positions on groove 21 (FIG. 4) corresponding to an closed position shown in FIG. 8A and an open position shown in FIG. 8B. Additionally, stop element 11 prevents sliding edge 20 from sliding through the groove 21 in the direction opposite to the desired direction for card ejection (seen in FIG. 8B). Finally, pusher element 13 is disposed within the cavity of storage element 3 and provides a surface that acts upon card C1 to push card C1 to an accessible position where a user can access the card C1 when the second top slider component 6 is slid to an open position (as depicted in FIGS. 8A-8C).

Figure 9A:
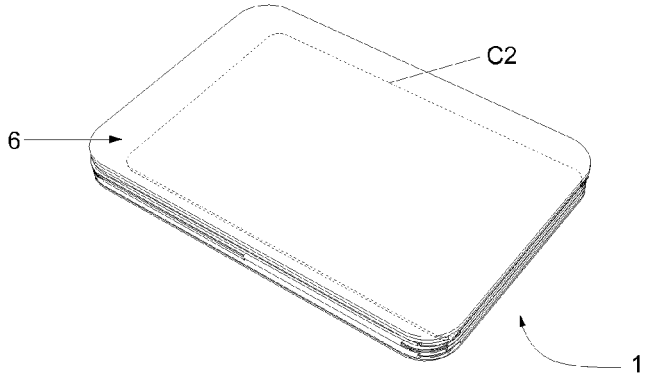
FIG. 9A shows a perspective view (identical to that of FIG. 8A) of the embodiment of the invention in FIG. 1 in its closed position with the location of the second card (from the top) called out with dashed lines.
Figure 9B:
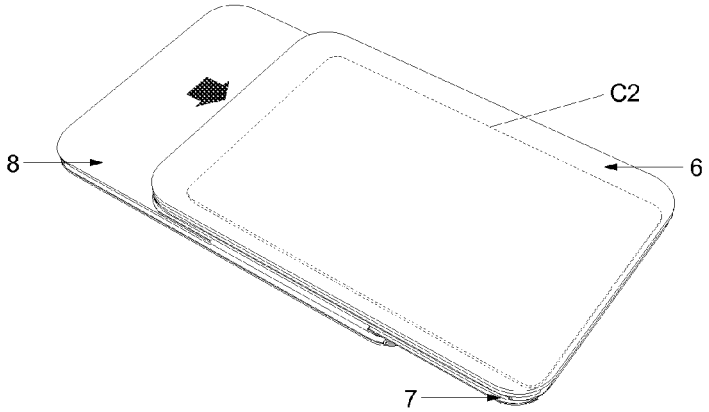
FIG. 9B shows the second component (from the top) slid open to its full extents with the second card ejected from it.
Figure 9C:
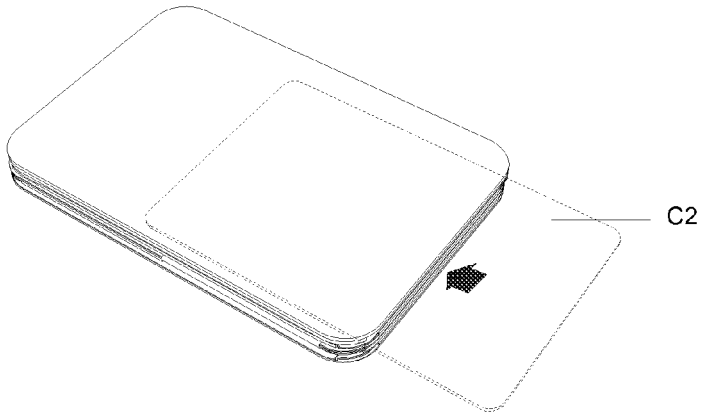
FIG. 9C shows the second component returned to its closed position after having ejected the second card.

In first top slider component 7, sliding edge 23 of storage element 4 corresponds to groove 24 extending from the top surface of base body 5 of base component 8 in a similar tongue and groove fashion to that described immediately above. Retention element 12A on sliding edge 23 mates with the positioning elements 14A of groove 24 in one of two positions, namely a closed position shown in FIG. 9A and an open position shown in FIG. 9B. Stop element 11A prevents sliding edge 23 from sliding through the groove 24 in the direction opposite to the desired direction for card ejection. Pusher element 15 is disposed within the cavity of storage element 4 and provides a surface that acts upon card C2 to push card C2 to an accessible position where a user can access the card C2 when the first top slider component 7 is slid to an open position (as depicted in FIGS. 9A-9C).

Base component 8 is the center piece of the invention below which components 6 and 7 are mirrored and appear as components 6A and 7A. Groove 22 extends from the bottom surface of base body 5 and receives the sliding edge 23A of the first bottom sliding component 7A in the same way that sliding edge 23 first top sliding component 7 corresponds to groove 24 of base component 8.

Figure 10A:
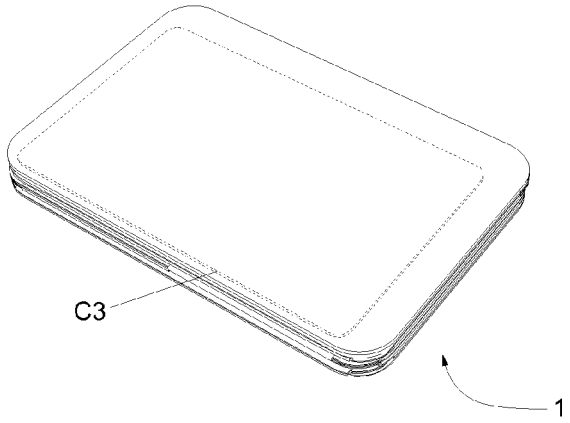
FIG. 10A shows a perspective view (identical to that of FIG. 8A) of the embodiment of the invention in FIG. 1 in its closed position with the location of the third card (from the top) called out with dashed lines.
Figure 10B:
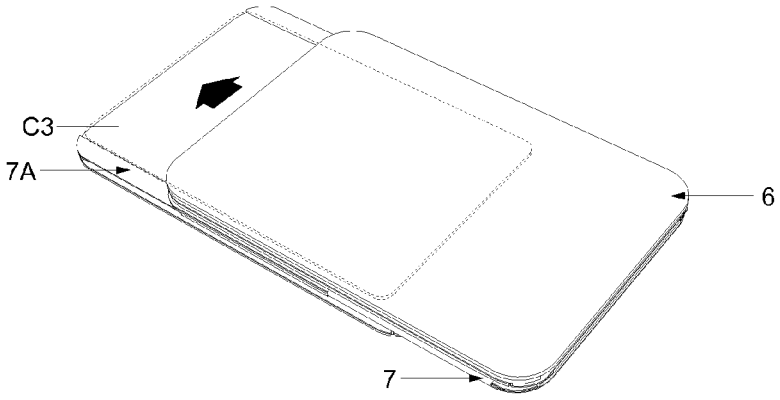
FIG. 10B shows the third component (from the top) slid open to its full extents with the third card ejected from it.
Figure 10C:
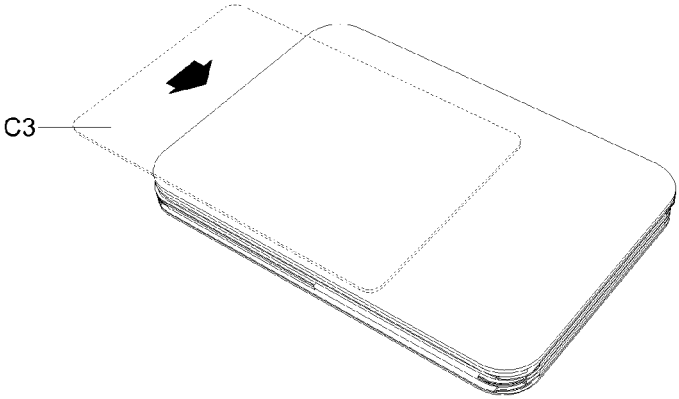
FIG. 10C shows the third component returned to its closed position after having ejected the third card.

First bottom sliding component 7A is similar to first top sliding component 7 but is located below base component 8. In particular, first bottom slider component 7A has sliding edge 23A of storage element 4A that corresponds to groove 22 extending from the bottom surface of base body 5 of base component 8. Retention element 12B on sliding edge 23A mates with the positioning elements 14A of groove 22 in one of two positions, namely a closed position shown in FIG. 10A and an open position shown in FIG. 10B. Stop element 11B prevents sliding edge 23A from sliding through the groove 22 in the direction opposite to the desired direction for card ejection. Pusher element 15A is disposed within the cavity of storage element 4A and provides a surface that acts upon card C3 to push card C3 to an accessible position where a user can access the card C3 when the first top slider component 7A is slid to an open position (as depicted in FIGS. 10A-10C).

Figure 11A:
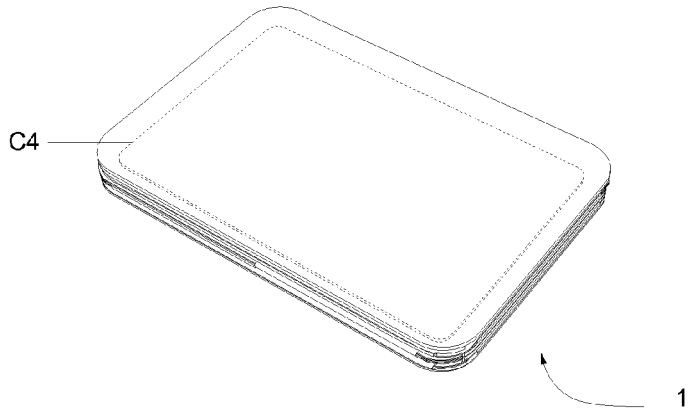
FIG. 11A shows a perspective view (identical to that of FIG. 8A) of the embodiment of the invention in FIG. 1 in its closed position with the location of the fourth card (from the top) called out with dashed lines.
Figure 11B:
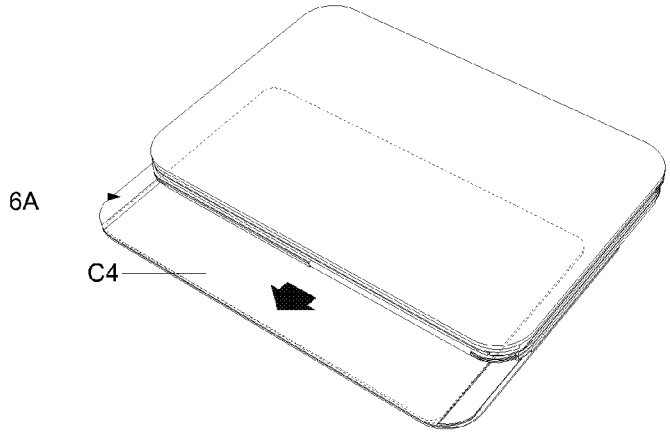
FIG. 11B shows the fourth component (from the top) slid open to its full extents with the fourth card ejected from it.
Figure 11C:
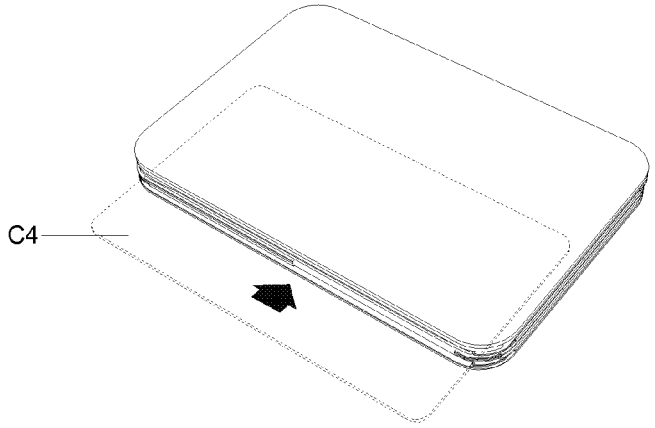
FIG. 11C shows the fourth component returned to its closed position after having ejected the fourth card.
Figure 12:
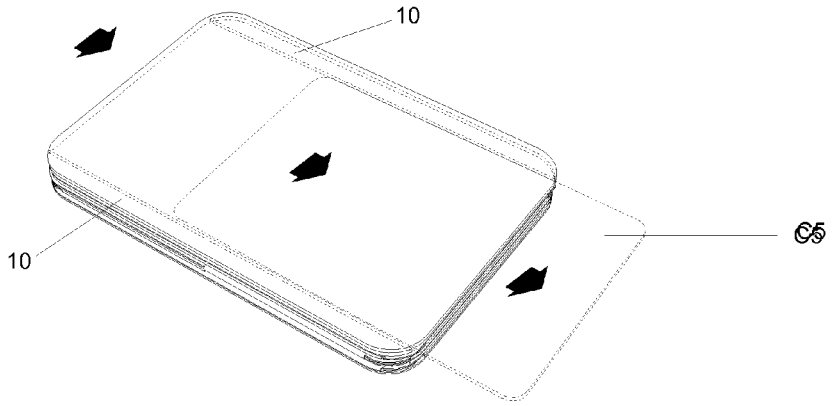
FIG. 12 shows a perspective view of the embodiment of the invention in FIG. 1 with the cover piece card partially exposed to indicate how it can be inserted and removed from the cover piece.

Second bottom sliding component 6A is identical to second top sliding component 6 but is located below component 7A. In particular, second bottom slider component 6A has cover piece 2A is the bottom-most piece of the card holder 1. The two riser elements 10A connect the cover piece 2A to the outermost surface of storage element 3A of the second bottom sliding component 6A, and in doing so creates a cavity for a card similar to the way card C5 is stored in second top sliding component 6. Sliding edge 20A is formed as a folded tongue feature of storage element 3A that fits into the groove 21A of storage feature 4A to allow the second bottom sliding component 6A to slide along the width of the first bottom sliding component 7A and reveal card C4. Stop element 11C and retention element 12 are disposed on sliding edge 20 to restrict the movement of sliding edge 20A through groove 21A. In particular retention element 12C mates with positioning element 14 in one of two positions on groove 21 corresponding to an closed position shown in FIG. 11A and an open position shown in FIG. 11B. Additionally, stop element 11C prevents sliding edge 20A from sliding through the groove 21A in the direction opposite to the desired direction for card ejection (seen in FIG. 11B). Finally, pusher element 13A is disposed within the cavity of storage element 3A and provides a surface that acts upon card C4 to push card C4 to an accessible position where a user can access the card C4 when the second top slider component 6 is slid to an open position (as depicted in FIGS. 11A-11C).

Elements 12 and 12A are depicted in FIG. 4 as having square edges, but their optimal shape would be one such that 12 and 12A engaged the cut-out features 14 and 14B in a way that produced enough friction for them to register in open and closed positions but not stifle the sliding action of the components to which they are connected. Those skilled in the art would be able to make changes to the specific design of the retention elements 12 and 12A and the positioning elements 14 and 14B within the scope of the invention to improve its function as it is depicted here.

Figure 13:
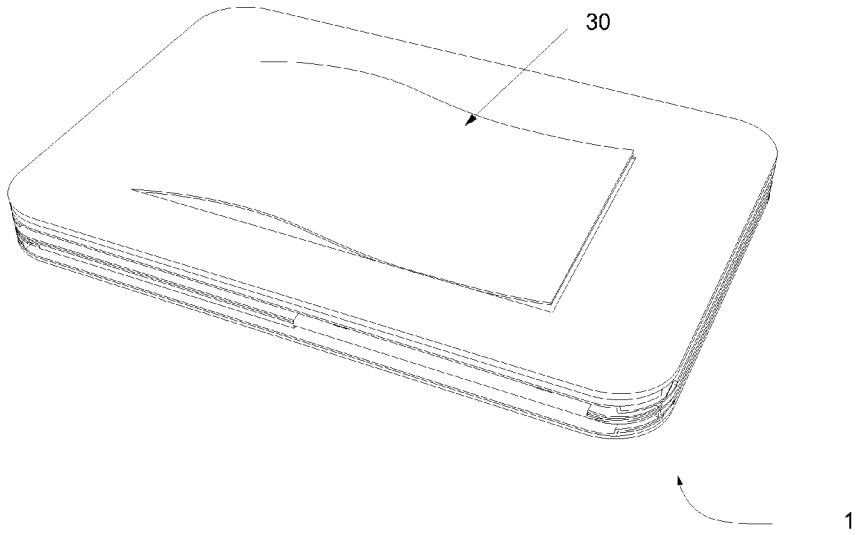
FIG. 13 shows a perspective view of another embodiment of the invention with the cover piece card having a money clip thereon.

FIG. 13 shows a money clip 30 on the cover piece 2. The money clip can be formed integrally with the cover piece 2, or can be otherwise affixed to cover piece 2 via adhesives, rivets, welding, or other known method of affixing parts together.

While a card holder with four separate sliding components has been the predominant embodiment described herein, any number of sliding components can be used to offer a card holder with the desired thickness and utility. For example, in one embodiment, two sliding components can be attached to a base component such that two selectively accessible cavities are formed. Furthermore, the base component could provide an outermost surface for a cover instead of the outermost surface of a sliding component.

As used herein, the term "card" can mean any type of substantially planar articles, including credit cards, business cards, transportation cards, identification cards, photographs, computer-readable storage cards, or similar.

The covers 2 and 2A could be made out of a variety of materials (such as leather, wood, carbon fiber, and plastics) that give aesthetic value and the option of customization to the card holder, or can be made of a material that allows for the transmission of RFID or similar radio signals so that it can be used without removal from the storage cavity.

While described herein predominantly as folded tongues and grooves, a sliding motion between the various components can be accomplished through various known structural configurations, such as tracks and riders, tracks with bearings, grooves and edges, etc. The sliding can be limited by the use of a stop or impediment that prevents the movement. Stops can be formed as integral parts of the components or can be added in a separate manufacturing step, such as by welding, adhesives, riveting, or other known permanent or temporary bonding method.

The components can be made of any suitably rigid material or combination of materials. Such materials can be metal, plastic, wood, etc. The outermost layer can include a cover piece that includes non-rigid materials such as leather, fabric, etc.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one or the entire group members are present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise. Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

We claim:

1. A holder for a plurality of cards, comprising:

a base component having a top surface and a bottom surface; and a first top sliding component having a top surface and a bottom surface, wherein the bottom surface of the first top sliding component is disposed adjacent but spaced from the top surface of the base component forming a first cavity therebetween, wherein the first cavity is sized to accommodate at least one card; and wherein the first top sliding component is slidingly engaged with the base component such that the first top sliding component can move along the top surface of the base component in a first direction between a closed position and open position; and whereby movement of the first top layer from a closed position to an open position moves the at least one card in the first cavity from an inaccessible position to an accessible position.

2. The holder of claim 1, further comprising a second top sliding component having a top surface and a bottom surface, wherein the bottom surface of the second top sliding component is disposed adjacent but spaced from the top surface of the first top sliding component forming a second cavity therebetween, wherein the second cavity is sized to accommodate at least one card; and wherein the second top sliding component is slidingly engaged with the first top sliding component such that the second top sliding component can move along the top surface of the first top sliding component in a second direction between a closed position and an open position; and whereby movement of the second top layer from a closed position to an open position moves the at least one card in the second cavity from an inaccessible position to an accessible position.

3. The holder of claim 2, further comprising a first bottom sliding component having a top surface and a bottom surface, wherein the top surface of the first bottom sliding component is disposed adjacent but spaced from the bottom surface of the base component forming a third cavity therebetween, wherein the third cavity is sized to accommodate at least one card; and wherein the first bottom sliding component is slidingly engaged with the base component such that the first bottom sliding component can move along the bottom surface of the base component in a third direction between a closed position and an open position; and whereby movement of the first bottom layer from a closed position to an open position moves the at least one card in the third cavity from an inaccessible position to an accessible position.

4. The holder of claim 3, further comprising a second bottom sliding component having a top surface and a bottom surface, wherein the top surface of the second bottom sliding component is disposed adjacent but spaced from the bottom surface of the first bottom sliding component forming a fourth cavity therebetween, wherein the fourth cavity is sized to accommodate at least one card; and wherein the second bottom sliding component is slidingly engaged with the first bottom sliding component such that the second bottom sliding component can move along the bottom surface of the first bottom sliding component in a fourth direction between a closed position and an open position; and whereby movement of the second bottom layer from a closed position to an open position moves the at least one card in the fourth cavity from an inaccessible position to an accessible position.

5. The holder of claim 2, wherein the second direction is perpendicular to the first direction.

6. The holder of claim 3, wherein the third direction is opposite the first direction.

7. The holder of claim 4, wherein the fourth direction is opposite the second direction.

8. The holder of claim 1, wherein one of the base component and the first top sliding component comprise a stop element that prevents the first top sliding component from being removed from sliding past an open position.

9. The holder of claim 2, wherein one of the first top sliding component and the second top sliding component comprise a stop element that prevents the first top sliding component from being removed from sliding past an open position.

10. The holder of claim 3, wherein one of the base component and the first bottom sliding component comprise a stop element that prevents the first top sliding component from being removed from sliding past an open position.

11. The holder of claim 4, wherein one of the first bottom sliding component and the second bottom sliding component comprise a stop element that prevents the first top sliding component from being removed from sliding past an open position.

12. The holder of claim 1, further comprising a cover piece attached to an outermost layer of the holder.

13. The holder of claim 12, wherein the cover piece is spaced from the outermost layer forming a storage cavity, wherein the cavity is sized to accommodate a card.

14. The holder of claim 13, wherein the cover piece allows for the transmission of radio frequency signals therethrough.

15. The holder of claim 1, further comprising a money clip attached to an outer layer thereof.

16. The holder of claim 1, further including at least one retention element to retain a sliding component in a closed position or an open position.

17. The holder of claim 16, wherein the retention element corresponds to at least one positioning element, whereby a sliding component is retained in an open or closed position when the retention element is aligned with the at least one positioning element.

18. A card-holder for multiple credit-card sized cards comprising:

a first rectangular component having its shorter edges bent into tongues, a second rectangular component having its longer edges bent into tongues and its shorter edges bent into grooves to form a sliding track for said tongues of first component, whereby said first component can move into an open and closed position with respect to said second component a third rectangular center component having it's longer edges bent into grooves, one half of which face up and receive the tongues of said second rectangular component, the other half of which face down and receive an upside-down duplicate of said second rectangular component a duplicate of said first rectangular component connected to said duplicate of second rectangular component.

19. The holder of claim 4, wherein the second direction is perpendicular to the first direction, the third direction is opposite the first direction, and the fourth direction is opposite the second direction.

* * * * *